US011350691B2

(12) United States Patent
Fritzell et al.

(10) Patent No.: US 11,350,691 B2
(45) **Date of Patent: *Jun. 7, 2022**

(54) BIKE HELMET WITH IMPROVED VENT COVER

(71) Applicant: Bolle Brands, Inc., New York, NY (US)

(72) Inventors: Tove Fritzell, Chamonix (FR); Gregg T. Jacobsen, Santa Cruz, CA (US)

(73) Assignee: Bolle Brands, Inc., New York, NY (US)

( * ) Notice: Subject to any disclaimer, the term of this patent is extended or adjusted under 35 U.S.C. 154(b) by 193 days.

This patent is subject to a terminal disclaimer.

(21) Appl. No.: 16/793,518

(22) Filed: Feb. 18, 2020

(65) Prior Publication Data

US 2020/0178640 A1 Jun. 11, 2020

Related U.S. Application Data

(63) Continuation of application No. 15/839,290, filed on Dec. 12, 2017, now Pat. No. 10,561,194.

(51) Int. Cl.

| | |
|---|---|
| ***A42B 3/32*** | (2006.01) |
| ***A42B 3/04*** | (2006.01) |
| ***A42B 3/28*** | (2006.01) |

(52) U.S. Cl.

CPC ..... *A42B 3/32* (2013.01); *A42B 3/0493* (2013.01); *A42B 3/283* (2013.01)

(58) Field of Classification Search

CPC ..... A42B 3/32; A42B 3/0493; A42B 3/283

USPC ..... 2/425

See application file for complete search history.

(56) References Cited

U.S. PATENT DOCUMENTS

| | | | | |
|---|---|---|---|---|
| 5,829,065 | A * | 11/1998 | Cahill | A42B 3/227 2/418 |
| 5,950,244 | A * | 9/1999 | Fournier | A42B 3/128 2/414 |
| 6,904,618 | B2 * | 6/2005 | Musal | A42B 3/283 2/410 |
| 7,975,320 | B2 * | 7/2011 | Muskovitz | A42B 3/283 2/425 |
| 8,683,617 | B2 * | 4/2014 | Chilson | A42B 3/283 2/171.1 |
| 10,561,194 | B2 * | 2/2020 | Fritzell | A42B 3/283 |

(Continued)

*Primary Examiner* — Gloria M Hale

(74) *Attorney, Agent, or Firm* — Lerner, David, Littenberg, Krumholz & Mentlik, LLP

(57) ABSTRACT

A helmet that includes vents in the shell and removable plugs that may be positioned in the vents to provide an airtight seal while maintaining the aerodynamic shape of the helmet. The vent has an outer vent opening in the outer wall surface of the shell and an inner vent opening in the inner wall surface of the shell. The plug includes a resilient lower surface and an upper surface opposite the resilient lower surface. The resilient lower surface has a lower peripheral lip that compresses when the plug is pushed through the outer vent opening and the inner vent opening and that subsequently expands after the lower peripheral lip passes through the inner vent opening so that the lower peripheral lip engages a portion of the inner wall surface of the shell. The upper surface has an upper peripheral lip configured to conform to a portion of the outer wall surface of the shell when the plug is inserted in the vent.

17 Claims, 6 Drawing Sheets

(56) References Cited

U.S. PATENT DOCUMENTS

| | | | | |
|---|---|---|---|---|
| 2002/0124298 | A1* | 9/2002 | Muskovitz | A42B 3/283 2/410 |
| 2004/0064873 | A1* | 4/2004 | Muskovitz | A42B 3/283 2/410 |

* cited by examiner

BIKE HELMET WITH IMPROVED VENT COVER

CROSS-REFERENCE TO RELATED APPLICATIONS

The present application is a continuation of U.S. patent application Ser. No. 15/839,290, filed Dec. 12, 2017, now U.S. Pat. No. 10,561,194, issued on Feb. 18, 2020, all of which are hereby incorporated herein by reference.

BACKGROUND

A helmet that can be worn for biking, skiing, skateboarding, or the like often has vents that allow heat to exit the helmet and exterior air to enter the helmet to cool the wearer's head. However, in cold and/or rainy conditions, a vented helmet can be uncomfortable because cold air and/or moisture seep through the vents and chill the wearer. To remedy this, many helmets have mechanisms for closing the vents. For example, one type of helmet has sliders or blades that slidably cover the vents. However, the sliders fail to effectively prevent moisture from seeping into the vents and sometimes get stuck in their opened or closed positions. Another type of helmet employs a cloth rain cover having an elastic perimeter that slips over the outside of the helmet; however, the elastic perimeter can become worn and inelastic with use so that it does not remain in place on the helmet. Further, the cloth material increases drag due to air friction, and it can be tedious to place on the helmet.

The background discussion is intended to provide information related to the present invention which is not necessarily prior art.

SUMMARY

The present invention solves the above-described problems and other problems by providing a helmet having vents and removable plugs that may be positioned in the vents to provide an airtight seal while maintaining the aerodynamic shape of the helmet. The plugs are durable for frequent use and are configured to be quickly and easily placed in the vents and held firmly therein.

A helmet constructed according to one embodiment of the present invention broadly includes a shell, at least one vent, and at least one plug. The shell is configured to receive a wearer's head and includes an inner wall surface, an outer wall surface, a front region, a rear region, a crown region between the front region and the rear region, and two side regions on opposite sides of the crown region. The shell may be constructed of any suitable material and may be held on a wearer's head by a strap or other mechanism.

The vent extends between the outer wall surface and the inner wall surface of the shell for venting heat from the wearer's head. The vent has an outer vent opening in the outer wall surface of the shell and an inner vent opening in the inner wall surface of the shell, and in one embodiment, tapers inwardly from the outer vent opening to the inner vent opening. The helmet may have any number of vents.

The plug may be removably positioned inside the vent to prevent air and water from passing through the vent and includes a resilient lower surface and an upper surface opposite the resilient lower surface. The resilient lower surface has a lower peripheral lip that compresses when the plug is pushed through the outer vent opening and the inner vent opening and that subsequently expands after the lower peripheral lip passes through the inner vent opening so that the lower peripheral lip engages a portion of the inner wall surface of the shell. The upper surface has an upper peripheral lip configured to conform to a portion of the outer wall surface of the shell when the plug is inserted in the vent. The helmet may have any number of plugs, preferably one plug per vent.

To install the plug in the vent, the resilient lower surface is placed into the outer vent opening and the upper surface of the plug is pushed downward until the lower peripheral lip compresses and passes through the inner vent opening of the shell. The lower peripheral lip then expands to engage the inner wall surface of the shell to firmly hold the plug in the vent.

To remove the plug from the vent, the upper surface of the plug is pulled upwardly away from the shell until the lower peripheral lip compresses and passes through the inner vent opening. Alternatively, the resilient lower surface of the plug may be compressed and then pushed from inside the shell toward the outer wall surface of the shell so that the lower peripheral lip compresses and passes through the inner vent opening. The plug can thereafter be freely removed from the outer wall surface of the shell.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
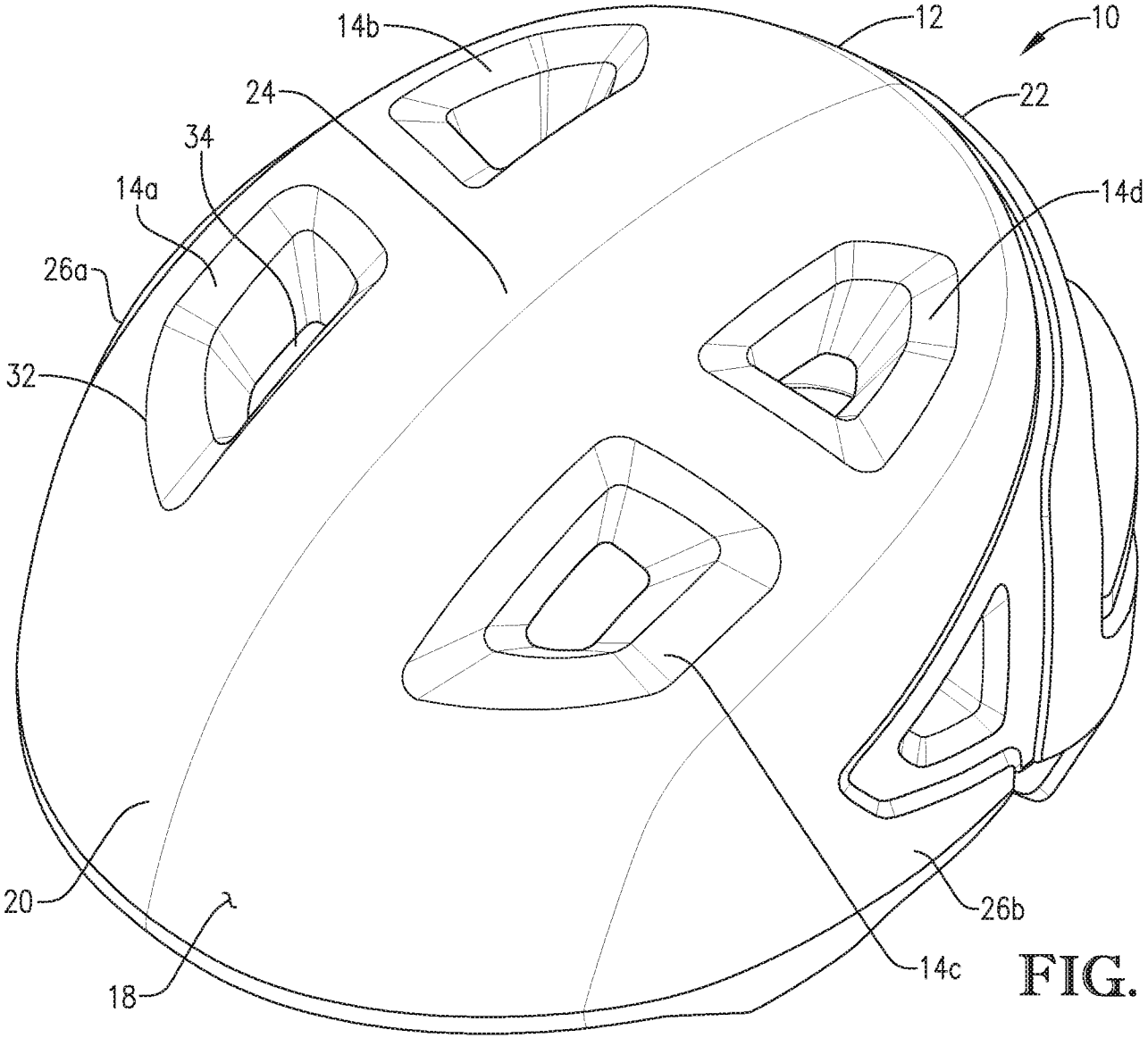
FIG. 1 is a top perspective view of a helmet constructed in accordance with an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

The present invention broadly concerns a helmet including a shell, at least one vent in the shell, and a plug for removably closing the vent. The plug provides an airtight seal while maintaining the aerodynamic shape of the helmet. The plug is durable for frequent use and is configured to be quickly and easily placed in the vent and held firmly therein. The helmet may include any number of vents and plugs and may be configured for use in any sport or activity.

Figure 2:
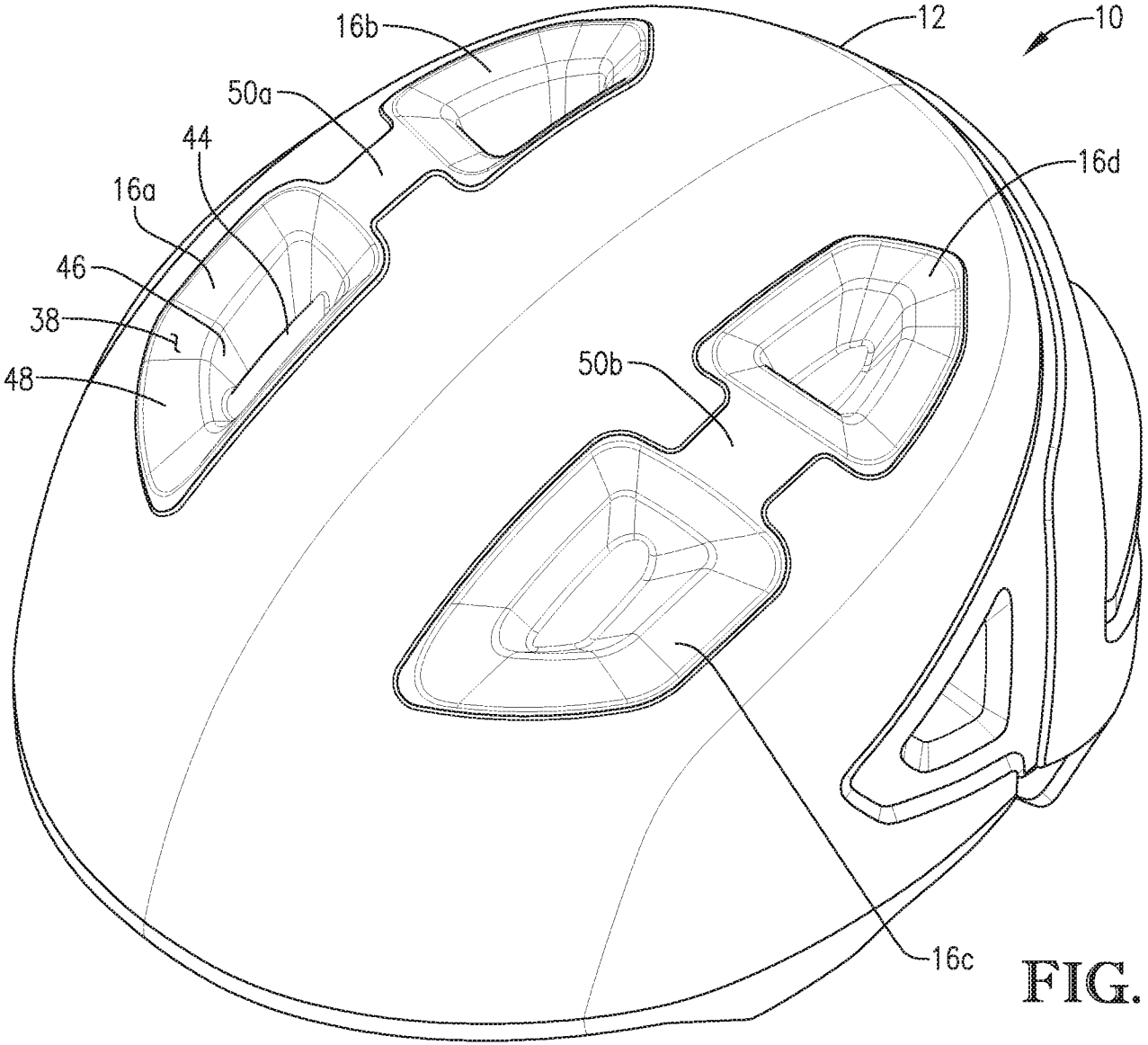
FIG. 2 is a top perspective view of the helmet of FIG. 1 having a pair of plugs installed thereon.

A helmet 10 constructed in accordance with a specific embodiment of the invention is illustrated in FIGS. 1-7. The helmet 10 is ideally suited for bicyclists and broadly includes a shell 12, four vents 14*a,b,c,d* extending through the shell 12, and four plugs 16*a,b,c,d* that may be removably positioned in the vents 14*a,b,c,d*. FIG. 1 shows the helmet 10 with the plugs 16*a,b,c,d* removed, and FIG. 2 shows the helmet with the plugs 16*a,b,c,d* installed in the vents 14*a,b,c,d*.

Figure 3:
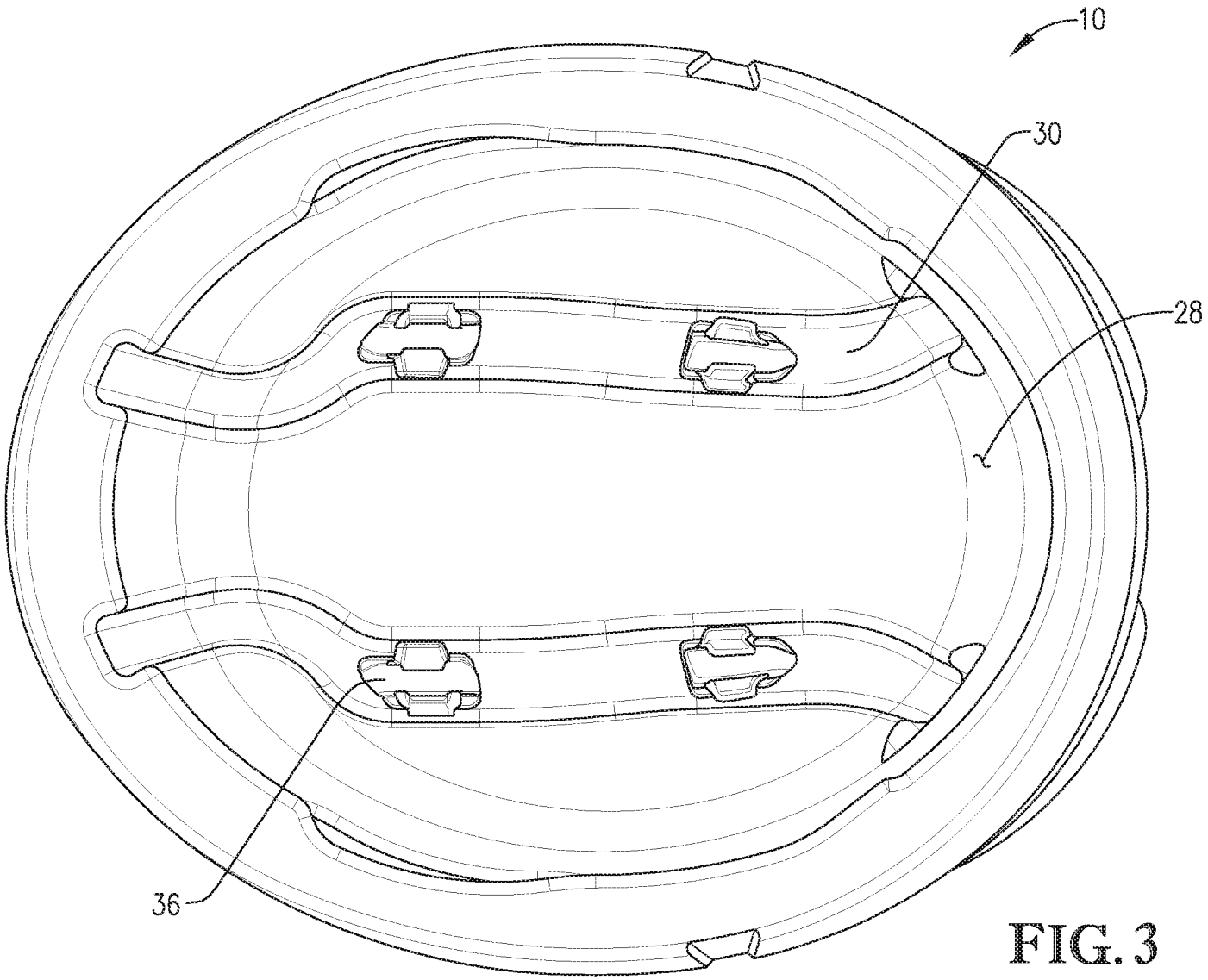
FIG. 3 is a bottom perspective view of the helmet of FIG. 2.

The shell 12 is configured to be worn on a wearer's head to provide protection from collisions as well as rain, sunlight, etc. The shell 12 includes an outer wall surface 18, a front region 20, a rear region 22, a crown region 24 between the front region 20 and the rear region 22, two side regions 26*a,b* on opposite sides of the crown region 24, and an inner wall surface 28 (as shown in FIG. 3). The shell 12 may be made of any suitable material and may be held on the wearer's head by a strap or other mechanism. In some embodiments, the shell 12 may include a series of channels 30 located on the inner wall surface 28 for directing air over the wearer's head.

The vents 14*a,b,c,d* allow heat to exit the helmet 10 and exterior air to enter the helmet 10 to cool the wearer's head and may be located anywhere on the shell 12, such as the crown region 24, as shown in FIG. 1. In one embodiment, vent 14*a* and vent 14*b* are located on a portion of the crown region 24 near the first side region 26*a* with vent 14*a* being near the front region 20 and vent 14*b* being near the rear region 22. Vent 14*c* and vent 14*d* are located on a portion of the crown region 24 near the second side region 26*b* with vent 14*c* being near the front region 20 and vent 14*d* being near the rear region 22.

Figure 4:
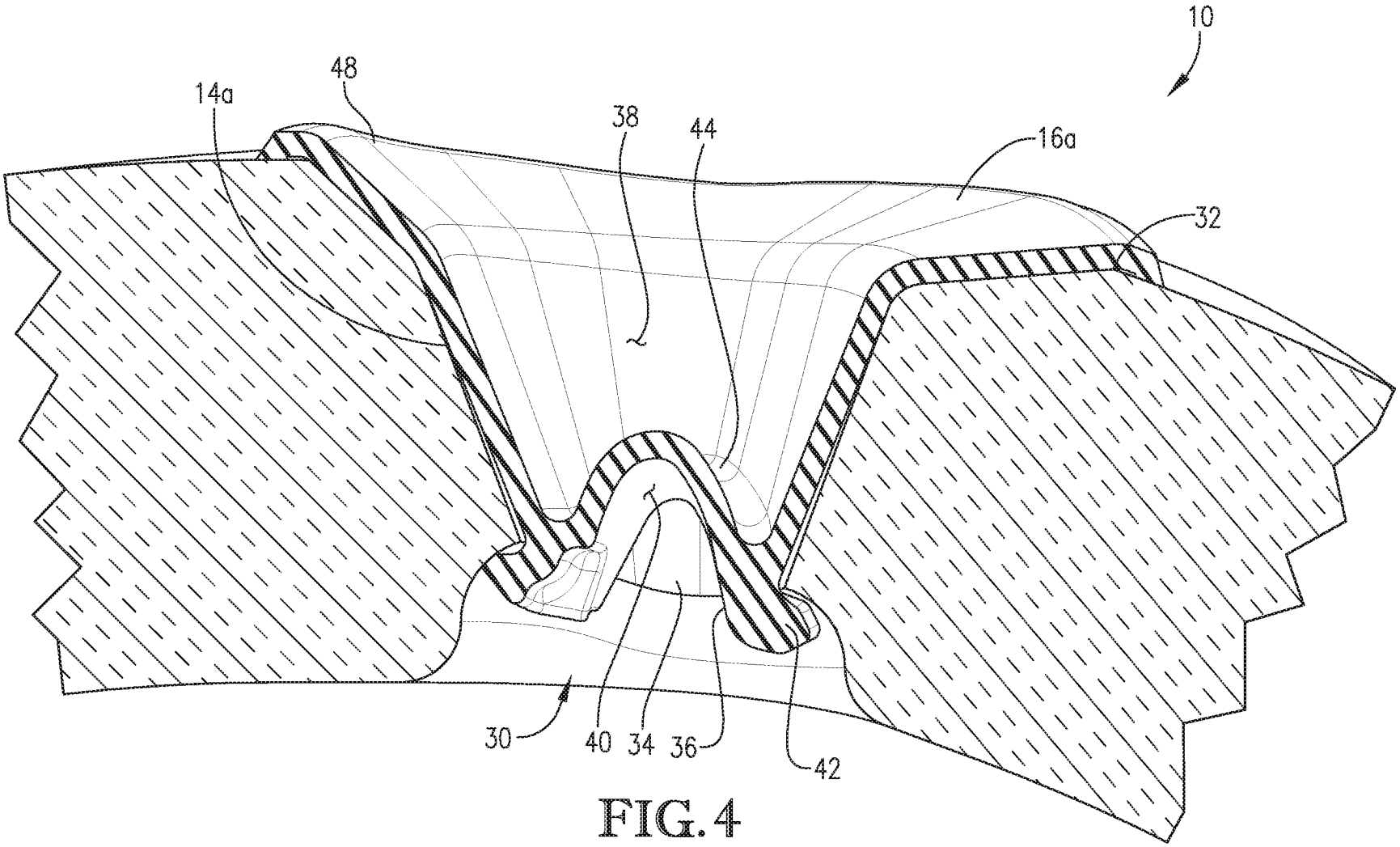
FIG. 4 is a fragmentary view of the helmet of FIG. 2 depicting a resilient lower surface installed in a vent of the helmet.
Figure 5:
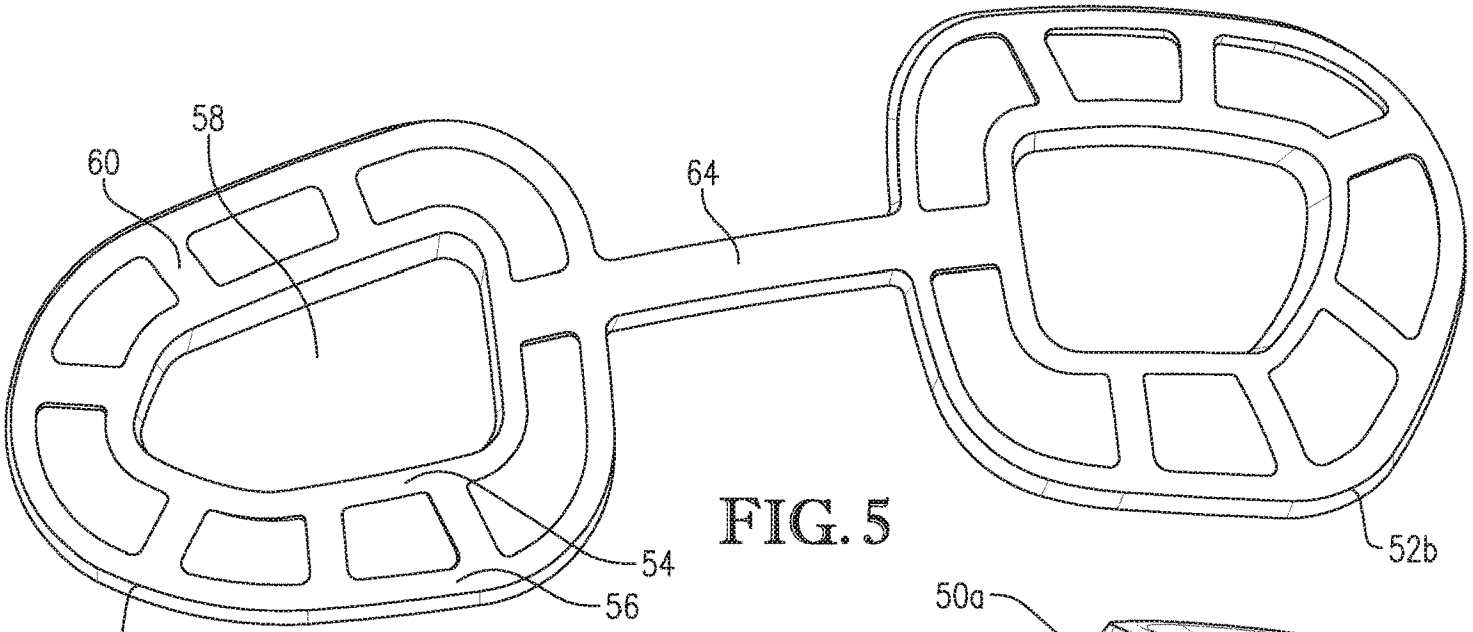
FIG. 5 is a top perspective view of a pair of support brackets of a helmet constructed in accordance with another embodiment of the present invention.

The vents 14*a,b,c,d* are substantially identical, so only one of them, 14*a*, will be described in detail. The vent 14*a* extends between the outer wall surface 18 and the inner wall surface 28 of the shell 12. The vent 14*a* includes an outer vent opening 32 in the outer wall surface 18, and an inner vent opening 34 in the inner wall surface 28. As best shown in FIG. 4, the vent 14*a* may taper inwardly from its outer vent opening 32 to its inner vent opening 34.

The plugs 16*a,b,c,d* may be removably positioned inside the vents 14*a,b,c,d* to prevent air and water from passing through the vents 14*a,b,c,d*. The helmet 10 may include any number of plugs but preferably includes a plug for each vent. Thus, an embodiment of the helmet 10 has four plugs 16*a,b,c,d* and four vents 14*a,b,c,d*. The plugs 16*a,b,c,d* are substantially identical, so only one of them, 16*a*, will be described in detail. As shown in FIG. 4, the plug 16*a* includes a resilient lower surface 36 (shown in FIG. 3) and an upper surface 38 opposite the resilient lower surface 36. The plug 16*a* may be made of any resilient material including rubber, silicone, a material having polyvinyl chloride (PVC), polyethylene, and/or the like.

The resilient lower surface 36 of the plug 16*a* includes a concave-shaped central portion 40 and a lower peripheral lip 42 that extends from the central portion 40. When the plug 16*a* is position in the outer vent opening 32 and its lower surface 36 is pushed through the inner vent opening 34, its lower peripheral lip 42 compresses and then subsequently expands after the lower peripheral lip 42 passes through the inner vent opening 34. Upon expanding, the lower peripheral lip 42 engages a portion of the inner wall surface 28 of the shell 12.

The upper surface 38 of the plug 16*a* includes a convex-shaped central portion 44, an angled sidewall 46 extending upwardly and outwardly from the central portion 44, and an upper peripheral lip 48 extending from the sidewall 46. The upper peripheral lip 48 is configured to conform to a portion of the outer wall surface 18 of the shell 12 when the plug 16*a* is inserted in the vent 14*a*. The upper surface 38 may provide an airtight sealing contact with the portion of the outer wall surface 18 to which the upper peripheral lip 48 is configured to conform.

In some embodiments, the helmet 10 may include one or more links 50*a,b* that conform to a shape of a portion of the outer wall surface 18 and that connects two or more plugs 16*a,b,c,d*. For example, as shown in FIG. 2, plug 16*a* and plug 16*b* are connected by a link 50*a* that conforms to a portion of the crown region 24 between vent 14*a* and vent 14*b*. Likewise, plug 16*c* and plug 16*d* are connected by a link 50*b* that conforms to a portion of the crown region 24 between vent 14*c* and vent 14*d*.

Figure 6:
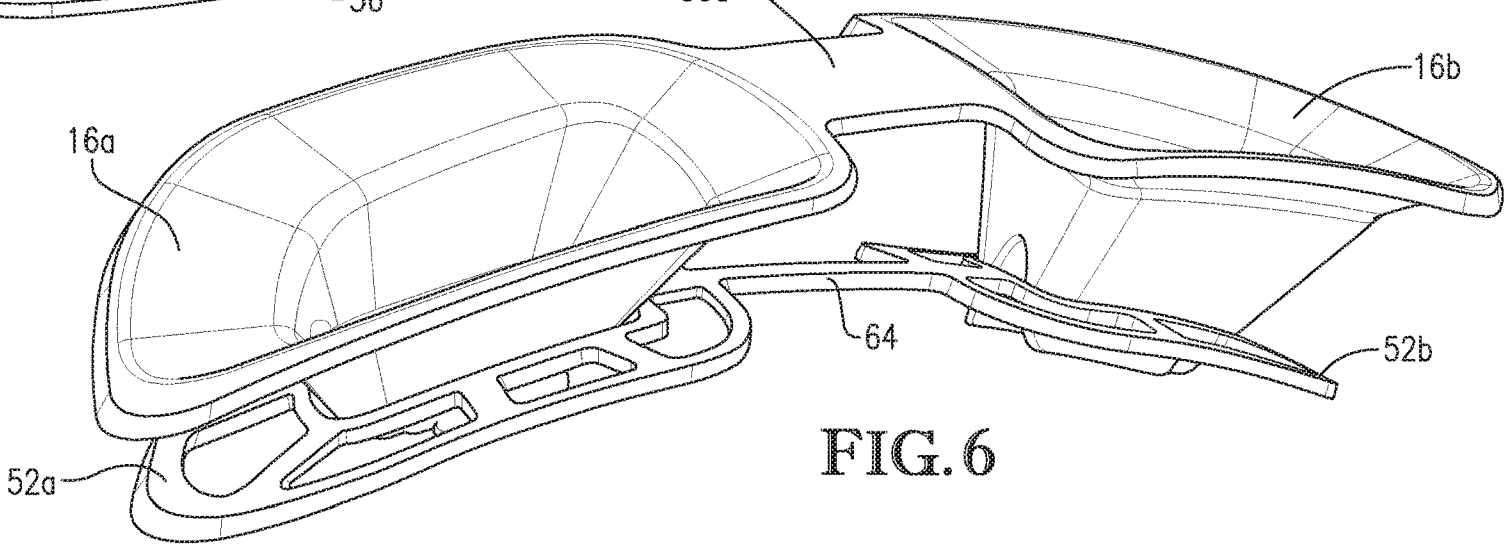
FIG. 6 is a side perspective view of a pair of plugs positioned in the pair of support brackets of FIG. 5.
Figure 7:
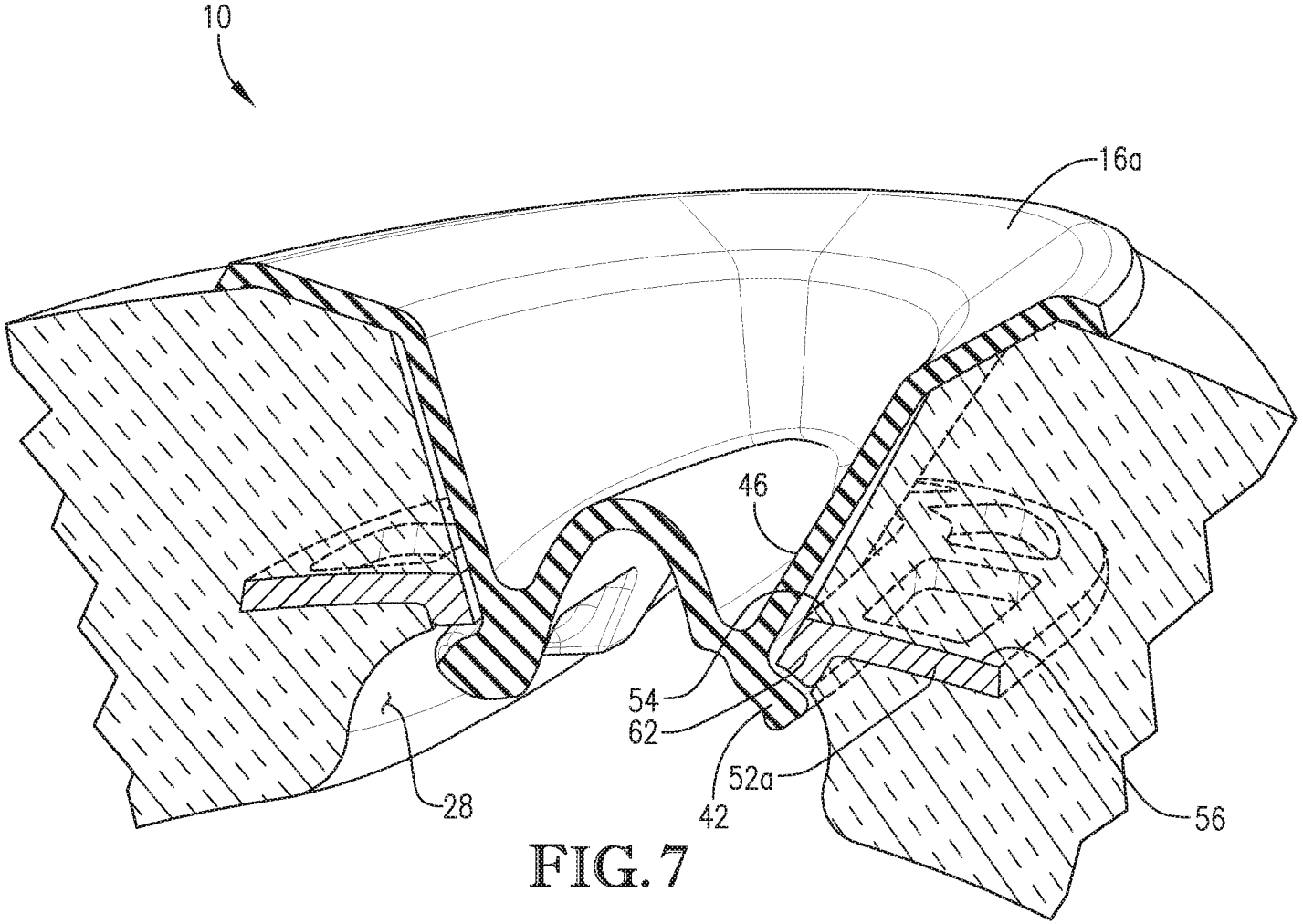
FIG. 7 is a fragmentary view of the helmet of FIG. 5 depicting a resilient lower surface engaged with a support bracket.

In some embodiments, the helmet 10 may include one or more support brackets 52*a,b* for reinforcing the portions of the inner wall surface 28 engaged by the lower peripheral lip 42 of the plug 16*a*, as shown in FIG. 7. The support brackets 52*a,b* are substantially identical, so only one of them, 52*a*, will be described in detail. The support bracket 52*a* may be positioned on, within, or attached to the inner surface wall 28 of the shell 12. In some embodiments, the support bracket 52*a* is embedded within the shell 12 around the inner vent opening 34 of the vent 14*a*. The support bracket 52*a* may include an inner wall 54 concentric with an outer wall 56, an internal opening 58 defined by the inner wall 54 that is coaxial with the inner vent opening 34 of the shell 12, a plurality of interconnecting ribs 60 that join the inner wall 54 and outer wall 56, and a flange 62 depending from the inner wall 54 (as shown in FIG. 7). The flange 62 may provide an engagement surface for the lower peripheral lip 42 of the plug 16*a*. The support brackets 52*a,b* may be made of any durable material including plastic, PVC, metal, and/or the like. In some embodiments, the helmet 10 may include a support bracket link 64 that is configured to connect support brackets. For example, as shown in FIG. 6, support bracket 52*a* is connected via support bracket link 64 to support bracket 52*b*.

In use, the plug 16*a* may be installed in the vent 14*a* by placing its resilient lower surface 36 into the outer vent opening 32 and pushing the upper surface 38 of the plug 16*a* downwardly until the lower peripheral lip 42 passes through the inner vent opening 34 of the shell 12. The lower peripheral lip 42 then expands to engage the inner wall surface 28 of the shell 12 or the flange 62 of the support bracket 52*a*.

To remove the plug 16*a* from the vent 14*a*, the upper surface 38 of the plug 16*a* is pulled upwardly away from the shell 12 until its lower peripheral lip 42 compresses and passes through the inner vent opening 34 of the shell 12 and/or the internal opening 58 of the support bracket 52*a*. Alternatively, the resilient lower surface 36 of the plug 16*a* may be pushed from inside the shell 12 toward the outer wall surface 18 of the shell 12 so that the lower peripheral lip 42 compresses and passes through the inner vent opening 34 and/or the internal opening 58 of the support bracket 52*a*. The plug 16*a* can thereafter be freely removed from the outer wall surface 18 of the shell 12.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A helmet comprising:

a shell configured to receive a wearer's head, the shell having a vent extending between an outer wall surface and an inner wall surface of the shell, the vent having an outer vent opening in the outer wall surface and an inner vent opening in the inner wall surface; and a removable plug configured to be positioned inside the vent, the removable plug including a lower peripheral lip that engages a portion of the inner wall surface of the shell and an upper peripheral lip that conforms to a portion of the outer wall surface of the shell when the removable plug is inserted in the vent.

2. The helmet of claim 1, wherein a lower surface of the removable plug has a concave-shaped central portion from which the lower peripheral lip extends.

3. The helmet of claim 1, wherein an upper surface of the removable plug has a convex-shaped central portion from which the upper peripheral lip extends.

4. The helmet of claim 1, wherein the removable plug provides an airtight sealing contact with the portion of the outer wall surface of the helmet.

5. The helmet of claim 1, wherein the removable plug is made of a material selected from the group consisting of: rubber, silicone, PVC, and polyethylene.

6. The helmet of claim 1, further comprising a support bracket around the inner vent opening and wherein the support bracket is made of plastic.

7. A helmet comprising:

a shell configured to receive a wearer's head, the shell having a plurality of vents, each vent extending between an outer wall surface and an inner wall surface of the shell and having an outer vent opening in the outer wall surface and an inner vent opening in the inner wall surface; and a plurality of plugs configured to be removably positioned inside respective ones of the plurality of vents, each plug including a resilient lower surface having a lower peripheral lip that compresses when the plug is pushed through the outer vent opening and the inner vent opening and that subsequently expands after the lower peripheral lip passes through the inner vent opening so that the lower peripheral lip engages a portion of the inner wall surface of the shell, each plug further includes an upper surface conforming to a portion of the outer wall surface of the helmet when the plug is inserted in the vent.

8. The helmet of claim 7, further comprising a link configured to connect one of the plugs to at least one other plug.

9. The helmet of claim 7, further comprising a support bracket embedded within the shell around the inner vent opening reinforcing portions of the inner wall surface engaged by the lower peripheral lips of the plugs.

10. The helmet of claim 9, wherein the support bracket includes a plurality of concentric inner and outer walls joined by a plurality of interconnecting ribs, the inner walls defining internal openings that are coaxial with the inner vent openings.

11. The plug assembly of claim 10, wherein the support bracket further includes a plurality of flanges extending from the inner walls that provide engagement surfaces for the lower peripheral lips of the plugs.

12. A helmet comprising:

a shell having two pairs of vents located on a crown region of the shell, each pair of vents including a front vent and a rear vent, each vent having an outer vent opening in an outer wall surface of the shell and an inner vent opening in an inner wall surface of the shell; and two pairs of plugs removably positioned inside the two pairs of vents, each plug having a lower peripheral lip that compresses when the plug is pushed through the outer vent opening and the inner vent opening; and each plug having an upper surface having an upper peripheral lip configured to conform to a portion of the outer wall surface of the helmet when the plug is inserted in the vent.

13. The helmet of claim 12 further comprising:

a support bracket embedded within the shell around the inner vent openings for receiving the resilient lower surfaces of the plugs so that resilient lower surfaces of the plugs expand after their lower peripheral lips pass through the inner vent openings and engage the support bracket.

14. The helmet of claim 12, wherein each pair of plugs has a link integrally attached to the upper surfaces of its respective plugs.

15. The helmet of claim 13, wherein the support bracket includes a plurality of concentric inner and outer walls joined by a plurality of interconnecting ribs, the inner walls defining internal openings that are coaxial with the inner vent openings.

16. The helmet of claim 12, wherein the upper surface of each of the plugs has a convex-shaped central portion and an angled sidewall extending upwardly and outwardly from the central portion from which the upper peripheral lip extends.

17. The helmet of claim 12, wherein a lower surface of each of the plugs has a concave-shaped central portion from which the lower peripheral lip extends.

* * * * *